US008710477B1

(12) United States Patent
Marchione

(10) Patent No.: US 8,710,477 B1
(45) Date of Patent: Apr. 29, 2014

(54) RADIATION PROTECTIVE GARMENT WITH FORCED VENTILATION AND METHOD

(76) Inventor: Robert L. Marchione, Randolph, VT (US)

( * ) Notice: Subject to any disclaimer, the term of this patent is extended or adjusted under 35 U.S.C. 154(b) by 550 days.

(21) Appl. No.: 13/134,497

(22) Filed: Jun. 9, 2011

Related U.S. Application Data

(60) Provisional application No. 61/397,347, filed on Jun. 11, 2010.

(51) Int. Cl.
*G21F 3/02* (2006.01)
*G21F 3/025* (2006.01)

(52) U.S. Cl.
USPC ..... 250/516.1; 250/515.1; 250/519.1; 2/2.17; 2/46; 2/338; 2/457

(58) Field of Classification Search
USPC ..... 250/516.1, 515.1, 519.1; 2/2.17, 46, 2/338, 457
See application file for complete search history.

(56) References Cited

U.S. PATENT DOCUMENTS

| | | | | |
|---|---|---|---|---|
| 3,242,979 | A * | 3/1966 | Shlosinger | 165/46 |
| 5,834,789 | A * | 11/1998 | Marchione | 250/516.1 |
| 7,476,889 | B2 * | 1/2009 | DeMeo et al. | 250/516.1 |
| 2009/0114857 | A1 * | 5/2009 | DeMeo et al. | 250/516.1 |

* cited by examiner

*Primary Examiner* — Nikita Wells
(74) *Attorney, Agent, or Firm* — William Nitkin

(57) ABSTRACT

A radiation protective garment having three layers including an inner layer having a plurality of apertures defined therein, a radiation protective layer and an outer layer, such garment having internal stays for supporting the garment's weight above the shoulders of the wearer with such weight resting on the wearer's waist/pelvic area, with the structure and method including an air movement device disposed on the exterior of the garment for directing an air flow through an air entry aperture formed in the outer layer and radiation protective layer with such air flow then passing through the plurality of apertures formed in the inner layer to cool the wearer of the garment. The air movement device and method can also include an air cooling device.

7 Claims, 3 Drawing Sheets

RADIATION PROTECTIVE GARMENT WITH FORCED VENTILATION AND METHOD

This application claims priority and benefit of a provisional patent application entitled Radiation Protective Garment with Forced Ventilation, Application No. 61/397,347 filed Jun. 11, 2010, now pending.

BACKGROUND OF THE INVENTION

1. Field of the Invention

This invention resides in the area of radiation protective garments and more particularly relates to a radiation protective garment having an air ventilation/cooling structure and method.

2. Description of the Prior Art

During the past thirty years, while many new medical imaging technologies have been introduced and accepted, the usage of an older modality, x-ray fluoroscopy, has quietly proliferated. X-ray fluoroscopy has become an imaging tool not only of choice, but also of necessity. X-ray fluoroscopy provides the ability to see within the body in real time and has moved from usage for simple x-ray diagnosis to usage in a vast array of medical treatments.

With the evolution and proliferation of fluoroscopy, a broader group of medical professionals have become engaged in its daily use, and subject to its inherent danger, being exposure to radiation. Increasingly, nurses, surgeons, physicians and technologists, in addition to radiologists or radiological technologists are either working with fluoroscopy or are present during its use.

While improving technology has decreased the radiation dose rates from what they were in the past, the use of fluoroscopy for treatment has not only expanded but has also called for increased exposure times, which length of radiation exposure often offsets the dose reductions realized by improved technology.

Thus, radiation safety is even more of an issue today than twenty-five years ago. Increasingly, personnel who are involved in the performance of these medical procedures are wearing radiation protective garments for longer periods of time. Radiation protective garments for use by persons subject to ionizing radiation during medical fluoroscopy or other activities are well known in the prior art. Such garments generally comprise inner cloth or vinyl linings and an outer cloth or vinyl covering with an intermediate layer of lead. This increased, prolonged usage of heavy radiation protective garments has caused the wearers of these heavy garments certain discomfort associated with their weight and overheating with attendant perspiration buildup.

The buildup of heat under heavy x-ray protective aprons, during long interventional and diagnostic procedures can be a major cause of user discomfort and fatigue. With conventional x-ray garments, this is buildup of heat is a serious problem because the user has body contact above the waist of virtually 100% of the heavy x-ray garment. My prior inventions taught in U.S. Pat. Nos. 5,834,789 and 5,844,246 provide some removal of apron body contact above the waist of the user by approximately 50%, helping to ease the problem by allowing some natural ventilation in the space between the garment and the user.

SUMMARY OF THE INVENTION

It is an object of this invention to provide an ergonomic, improved radiation protective garment of the type used during medical x-ray fluoroscopic procedures in which the operator of the fluoroscopic equipment and other occupational personnel are subject to exposure by ionizing radiation, such as directly and indirectly from x-ray fluoroscopic equipment.

It is a further object of this invention to provide a radiation protective garment in which all of the garment's weight is supported at the waist and hips of the wearer, and additionally the garment provides forced air ventilation and, in some embodiments, cooling. A problem experienced by the wearers of x-ray vests is that there is a significant buildup of heat, causing perspiration, from lack of ventilation under x-ray protective vests. My prior U.S. Pat. Nos. 5,834,789 and 5,844,246 lend themselves to better ventilation because the support stays hold the garment away from the body, thus creating an airspace. The invention herein improves my prior inventions by evenly circulating air inside the garment between the user's body and the garment and in some embodiments cools that air as well. This space between the garment and the user's body provides such enhanced ventilation by the addition of an air-moving method comprised of a lightweight, belt-mounted battery pack and fan. Through a flexible inlet pipe air is driven by the fan from outside the garment to inside the garment and distributed evenly, passing through the inner lining of the garment which can be constructed of a porous fabric or of fabric with apertures formed therein. The space between the porous fabric forming the inside of the garment that is nearest the user's body forms an air space that allows air to reach the user's body in a way which is as evenly distributed as possible. The porous fabric serves to help distribute the air within the garment to critical areas of the user's body, allowing for cooling and evaporation of perspiration. The method of air-moving can also, in some embodiments, be equipped with a cooling unit that will reduce the temperature of the air before it is blown into the garment.

DESCRIPTION OF THE PREFERRED EMBODIMENT(S)

Figure 1:
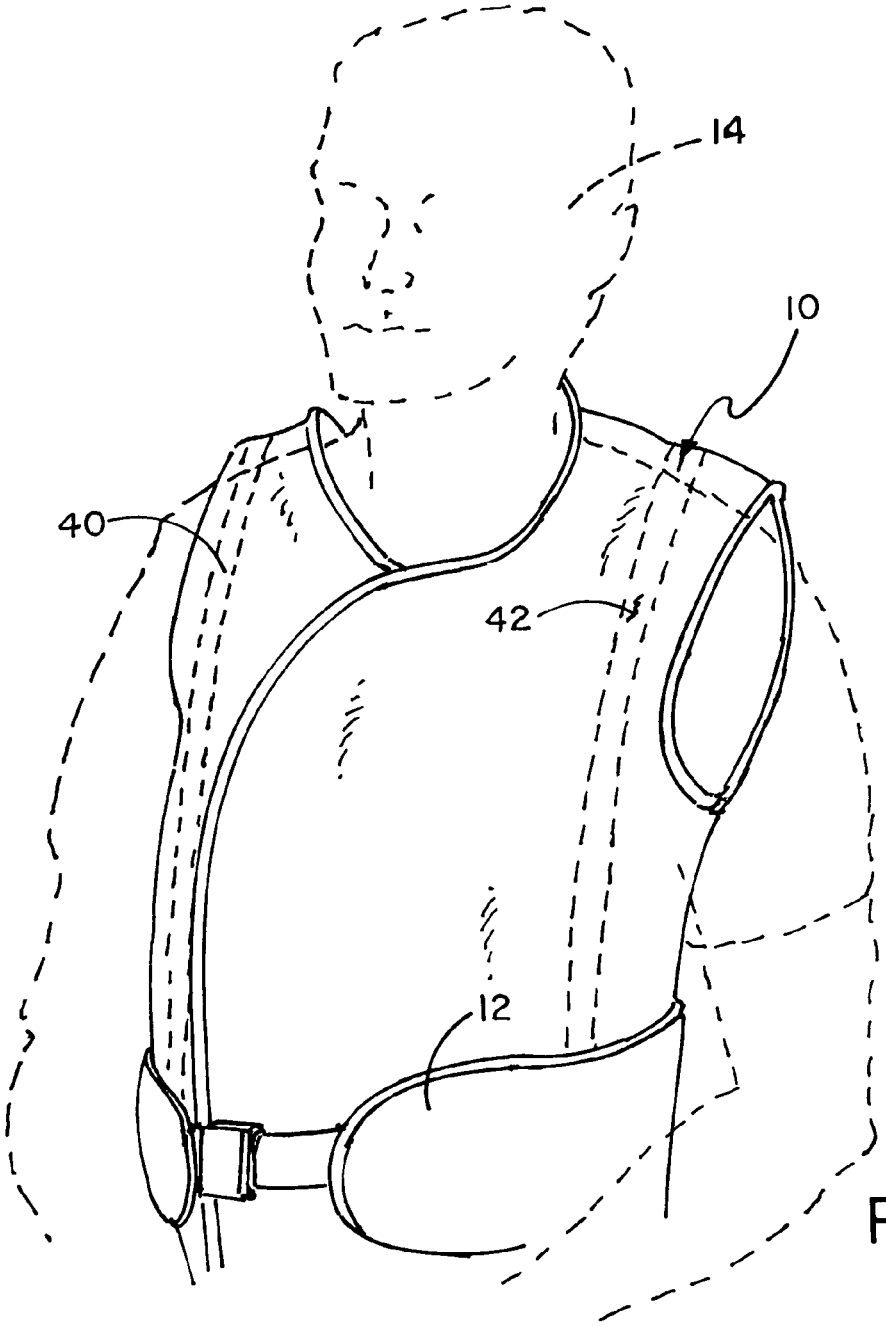
FIG. 1 illustrates a front perspective view of the radiation protective garment of this invention having stays which substantially lift the garment above the wearer's shoulders.

FIG. 1 illustrates a front perspective view of radiation protective garment 10 of this invention on wearer 14. Seen in this view is belt 12 which is utilized with first and second internal stays 40 and 42 shown in dashed lines and described above that hold the garment suspended above the shoulders of the wearer so that the weight of the garment is primarily disposed on the stays and thus supported on the belt around the wearer's waist and resting on the wearer's hips.

Figure 2:
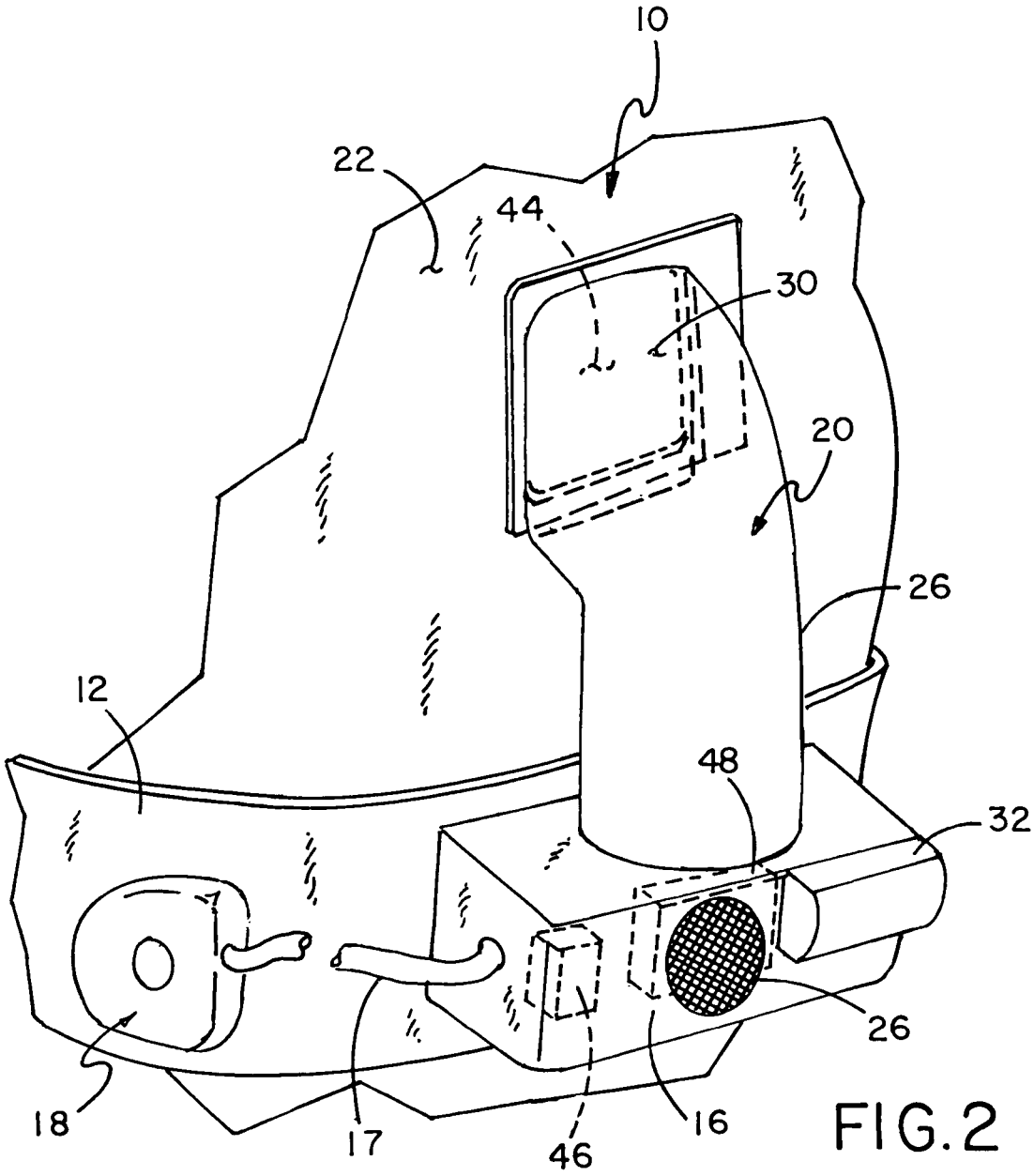
FIG. 2 illustrates a rear perspective view of a portion of the garment showing the air-moving structure/method of this invention mounted thereon.
Figure 3:
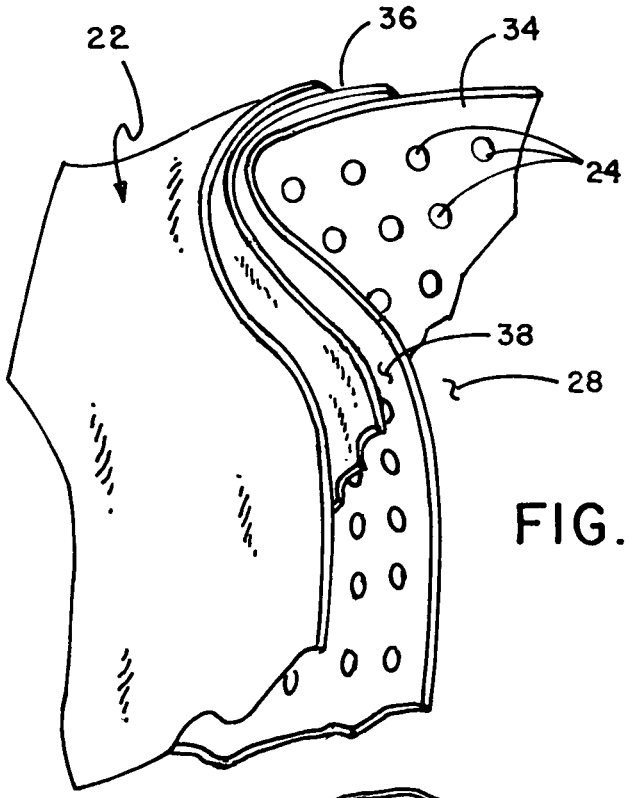
FIG. 3 illustrates a perspective cutaway view of a portion of the garment showing the three layers of the garment separated for purposes of illustration.
Figure 4:
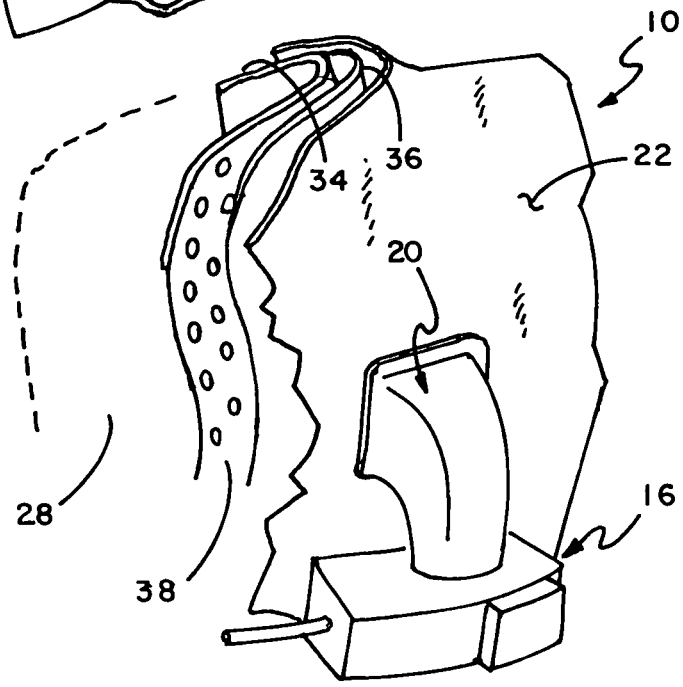
FIG. 4 illustrates a rear perspective cutaway view of the garment showing the air-moving structure/method and the three layers of the garment separated for purposes of illustration.

FIG. 2 illustrates a sectional rear perspective view of garment 10 where part of the method of the invention can be seen mounted on belt 12. The device includes housing 16 which is attached directly to belt 12 and has vent 26 defined therein extending to the exterior of housing 16. Internal fan 46 powered by battery 32 pulls air through vent 26 and directs it up through inlet pipe 20 into air entry aperture 30 which passes through exterior layer opening 44 in outer layer 22 and radiation protective layer 36, as also seen in FIG. 3, and exits between radiation protective layer 36 and inner layer 34 where the space between such layers forms air receipt channel 38, as seen in FIGS. 3 and 4. It should be noted that outer layer 22 is generally in contact with radiation protective layer 36 and held thereto by stitching, adhesive and the like and that the point of attachment of inlet pipe 20 also includes means to attach it to and hold together radiation protective layer 36 and outer layer 22. It should be noted that radiation protective layer 36 can often be made of more than one layer of material, all of which are referred to herein collectively as radiation protective layer 36. Inner layer 34 is not attached to radiation protective layer 36 and a space can be formed therebetween by air pressure, being air receipt channel 38 into which channel 38 air is blown through inlet pipe 20 extending from fan 46 in housing 16. Once the air passes into air receipt channel 38, which extends all around body receipt area 28, such air passes through perforations in inner layer 34 which can be in the from of a plurality of apertures 24 or equivalent openings, such as openings formed by loosely woven fabric with large open areas between the threads of the weave. Inner layer 34 is disposed adjacent to the wearer but, because of stays 40 and 42 within the structure of garment 10, inner layer 34 is substantially separated a distance from the wearer. Inner layer 34 has a plurality of apertures 24 defined therein along the entire inner layer's surface such that air forced from housing 16 through inlet tube 20 and through air entry aperture 30 and through exterior layer opening 44 in radiation protective layer 36 is directed within air receipt channel 38, such air then passing through plurality of apertures 24 into body receipt area 28. After passing around and cooling wearer 14, the air will vent out around the open neck area and the shoulder openings of the garment and around the hip area and other openings of the garment that will allow air to escape from the garment, thereby cooling the wearer and carrying away any moisture from perspiration, thus making the wearer of the garment more comfortable.

In an alternate embodiment of the invention, housing 16 can also contain cooling unit 48, as seen in FIG. 2, powered by battery 32. Cooling unit 48 cools the air moving within the garment, thus providing greater comfort to the wearer during prolonged wearing of the garment. The housing fan and/or cooling unit can be controlled by control unit 18 which can be disposed on belt 12 in an easy to reach area and be attached through wire 17 to housing 16. Control unit 18 can include multiple controls not only for the fan and the fan's level of operation, but also for the cooling unit for adjusting the temperature of the air within the garment.

Thus the method of this invention provides for cooling of the wearer of the garment by drawing in ambient air from the exterior, through housing 16 located on the rear of the garment where it is out of the user's way and does not interfere with the user's operation of medical equipment. The fan within housing 16 drives such air through inlet pipe 20 through air entry aperture 30 and through exterior layer opening 44 in radiation protective layer 36, as seen in FIG. 2 and into air receipt channel 38 formed between the radiation protective layer 36 and inner layer 34. Inner layer 34 can extend over exterior layer opening 44. Radiation protective layer 36 is also usually nearly air impenetrable and is usually a flexible, solid material. Inner layer 34 has a plurality of apertures 24 disposed therein such that when the air is forced through apertures 24 against the wearer's body and such air will then exit the garment where there is an opening such as in the area around the wearer's neck, the arm passage openings and in some cases the waist area that might not be completely sealed by support belt 12.

Although the present invention has been described with reference to particular embodiments, it will be apparent to those skilled in the art that variations and modifications can be substituted therefor without departing from the principles and spirit of the invention.

I claim:

1. A radiation protective garment for use by a wearer having a waist and shoulders, comprising in combination:

a flexible inner layer having a plurality of apertures defined therein, an outer layer and a radiation protective layer disposed between said inner layer and said outer layer, said garment having a weight, a first side, a second side, two shoulder portions, a front portion and a rear portion, each of said front and rear portions having a top portion, a waist portion and a bottom portion;

first and second stay members each formed in an inverted U-shape, said first and second stay members disposed within said garment, each stay member having front and rear ends and a top portion, each stay member extending from its front end at its respective front waist portion of said garment vertically over its respective top portion corresponding to the shoulder area of the wearer and downward to its rear end at said rear waist portion of said garment;

a support belt having means to attach said belt to said garment around said outer covering at said waist portion of said garment and means for securing said support belt tightly around said waist of said wearer;

said support belt positioning said top portions of said first and second stay members above said shoulders of said wearer wherein all of said weight of said garment is supported by said first and second stay members which are held in place by the support of said support belt by said front and rear ends of said stay members by said belt supported at said waist of said wearer;

said outer layer and radiation protective layer each having an air entry aperture defined therethrough in a portion of said garment above said support belt;

air-movement means disposed on said exterior of said garment; and a pipe connecting said air-movement means to said air entry aperture of said garment for directing a flow of air from the exterior said garment through said air entry aperture of said garment to the space defined between said radiation protective material layer and said inner layer, said air further passing through said plurality of apertures of said inner layer to be directed against the body of the wearer for cooling of said wearer.

2. The garment of claim 1 further including cooling means disposed within said air-movement means for cooling said air directed into said garment to promote further cooling of said wearer.

3. The garment of claim 1 wherein said air entry aperture is defined in said rear portion of said garment.

4. The garment of claim 2 wherein said air entry aperture is defined in said rear portion of said garment.

5. A method for the cooling of a wearer of a radiation protective garment supported at the waist/pelvic area of said wearer, said garment for use in an environment of x-ray radiation, said garment having a front, a rear, first and second side portions, a waist area portion, and first and second shoulder portions, said first and second shoulder portions each having a top point, comprising the steps of:

providing first and second stay members disposed, respectively, within said garment on said first and second side portions thereof, each of said stay members extending from its respective front waist area portion of said garment, over its respective shoulder portion, and down to its respective rear waist area portion of said garment;

providing a support belt attached at said waist area portion of said garment;

securing said support belt tightly about said waist/pelvic area of said wearer;

manually lifting said garment such that the distance from a point on said support belt near the bottom of a stay member at said waist of the wearer to the top of his shoulder is less than the distance measured from said same point on said support belt to the top point of its respective shoulder portion of said garment;

maintaining said first and second stay members at said height where its shoulder portions are positioned above and off the shoulders of said wearer;

supporting said weight of said garment on said first and second stay members by pressure of said support belt securely positioned against said waist portion of said garment;

forming said garment with a flexible inner layer, a radiation protective layer and an outer layer, said radiation protective layer disposed between said inner and outer layers;

forming a plurality of apertures within said inner layer of said garment;

forming an air entry aperture in said outer layer and said radiation protective layer of said garment extending through a portion of said garment above said support belt;

providing an air movement means disposed on the exterior of said garment adjacent to said outer layer;

interconnecting said air movement means to said air entry aperture defined in said garment;

directing a flow of air from said air movement means through said air entry aperture formed in said garment, said air passing into an air channel formed between said inner layer and said radiation protective layer;

forcing said air though said plurality of apertures defined in said inner layer against said wearer; and cooling said wearer by said forced air passing through said plurality of apertures in said inner layer against the wearer's body.

6. The method of claim 5 further including the step of:

cooling said air before directing it into said garment.

7. The method of claim 6 further including the step of:

positioning air cooling means on the rear of said garment.

* * * * *